US011830390B2

(12) United States Patent
Wicken et al.

(10) Patent No.: US 11,830,390 B2
(45) Date of Patent: Nov. 28, 2023

(54) MOVABLE DISPLAY SYSTEM

(71) Applicant: Balloon Innovations Inc., Westminster, CO (US)

(72) Inventors: Christopher Jon Wicken, Westminster, CO (US); Alex John Fountain, Evergreen, CO (US); Joshua Ryan Olson, Parker, CO (US)

(73) Assignee: BALLOON INNOVATIONS, INC., Westminster, CO (US)

( * ) Notice: Subject to any disclaimer, the term of this patent is extended or adjusted under 35 U.S.C. 154(b) by 0 days.

(21) Appl. No.: 17/815,622

(22) Filed: Jul. 28, 2022

(65) Prior Publication Data

US 2023/0029641 A1 Feb. 2, 2023

Related U.S. Application Data

(60) Provisional application No. 63/226,497, filed on Jul. 28, 2021.

(51) Int. Cl.

| | |
|---|---|
| ***G09F 7/00*** | (2006.01) |
| ***G09F 7/22*** | (2006.01) |
| *G09F 7/18* | (2006.01) |

(52) U.S. Cl.

CPC ..... *G09F 7/22* (2013.01); *G09F 2007/1804* (2013.01)

(58) Field of Classification Search

CPC ..... G09F 15/0037; G09F 15/00; G09F 7/18; F16M 11/22

USPC ..... 248/346.4, 346.5, 511, 160; 40/608, 40/607.12, 607.03

See application file for complete search history.

(56) References Cited

U.S. PATENT DOCUMENTS

| | | | | |
|---|---|---|---|---|
| 4,660,310 | A * | 4/1987 | Farmer | G09F 15/0006 40/607.06 |
| 4,894,937 | A * | 1/1990 | Davis | G09F 7/18 248/248 |
| 7,131,230 | B1 * | 11/2006 | Gilsdorf | A01M 31/06 43/2 |
| 7,437,844 | B1 * | 10/2008 | Kennedy | G09F 15/00 40/607.05 |
| 7,520,075 | B1 * | 4/2009 | Clark | G09F 7/18 40/607.06 |
| 8,429,944 | B2 * | 4/2013 | Liles | B21F 15/04 72/135 |
| 8,631,597 | B2 * | 1/2014 | Delorenzo | G09F 7/22 40/606.19 |
| 10,850,206 | B1 * | 12/2020 | Wicken | F16B 9/02 |
| 2002/0121033 | A1 * | 9/2002 | Hildyard | G09F 21/02 40/586 |
| 2013/0067784 | A1 * | 3/2013 | Parker | G09F 15/02 40/607.03 |

FOREIGN PATENT DOCUMENTS

| | | | | |
|---|---|---|---|---|
| CA | 2164230 A * | 6/1997 | | G09F 15/00 |

* cited by examiner

*Primary Examiner* — Cassandra Davis
(74) *Attorney, Agent, or Firm* — Berg Hill Greenleaf Ruscitti, LLP

(57) ABSTRACT

The invention includes systems, devices, and methods of using a novel movable display apparatus that may be particularly adapted to secure one or more advertising displays, such as a sign, banner or helium-free balloon, and may further be configured to move independently in response to an external force.

16 Claims, 5 Drawing Sheets

MOVABLE DISPLAY SYSTEM

CROSS-REFERENCE TO RELATED APPLICATIONS

This U.S. Non-Provisional application claims the benefit of and priority to U.S. Provisional Application No. 63/226,497 filed Jul. 28, 2021, the specification, claims and drawings of which are incorporated herein by reference in their entirety.

TECHNICAL FIELD

This invention described herein relates to a novel movable display apparatus configured to be used for outdoor or indoor marketing displays.

BACKGROUND

Traditional marketing displays, such as flags, banners, signs, and balloons are often placed in, or near commercial establishments to draw customer attention. In some cases, in an efforts to better attract consumer attention marketing displays are movable, for example through direct human intervention by a mechanical force generated by a machine, or a natural external force such as wind. In one traditional example, a marketing display, such as a sign is coupled with one end of a rigid metal H-stake with the opposing end being secured in the ground. These marketing display systems are easily bent in response in the wind and cannot generally be repositioned in their original form limiting their ability to be re-used. Moreover, these marketing display systems are static and cannot generate movement that would better catch the attention of a consumer or other observer. As such, there exists a need for a simple, and reusable system to provide for a movable marketing display.

SUMMARY OF THE INVENTION

In one aspect, the invention includes systems, devices, and methods of using a novel movable display apparatus that may be particularly adapted to secure one or more advertising displays, such as a sign, banner or helium-free balloon, and may further be configured to move independently of human intervention in response to force generated by wind. The novel movable display apparatus may be secured to an external surface, such as the ground, a wall, a weighted base, or other objects such as a car, pole or fence and may generate a movable marketing display to attract consumer attention.

Additional aspects of the present invention will become apparent through the detailed explanation below.

DETAILED DESCRIPTION OF THE INVENTION

Figure 1A:
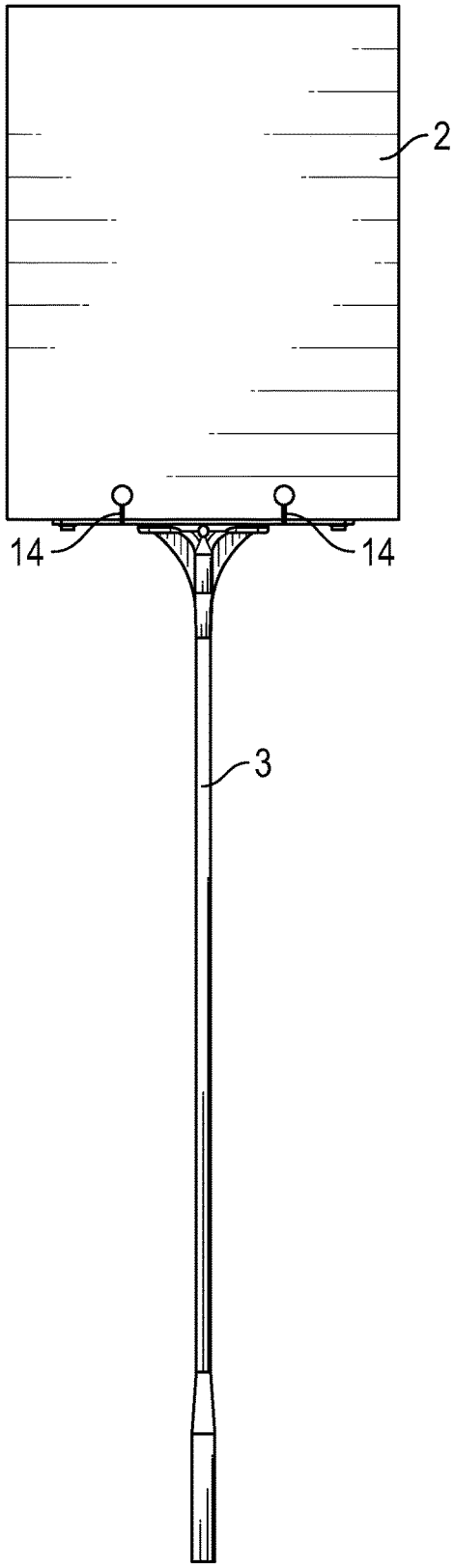
FIG. 1A shows a movable display system in one embodiment thereof.

The present invention includes a variety of aspects, which may be combined in different ways. The following descriptions are provided to list elements and describe some of the embodiments of the present invention. These elements are listed with initial embodiments; however, it should be understood that they may be combined in any manner and in any number to create additional embodiments. The variously described examples and preferred embodiments should not be construed to limit the present invention to only the explicitly described systems, techniques, and applications. Further, this description should be understood to support and encompass descriptions and claims of all the various embodiments, systems, techniques, methods, devices, and applications with any number of the disclosed elements, with each element alone, and also with any and all various permutations and combinations of all elements in this or any subsequent application.

The invention may include systems, methods and devices to produce movable display system (1). In the preferred embodiment shown in FIG. 2, a movable display system (1) may include a display mount (15) configured to secure on one or more marketing displays, such as a sign (2). The display mount (15) of the invention may further be secured to a flexible stem (3) through a stem engagement (4). Example stem engagements (4) may include a button lock device, as well as one or more coupler devices, such as a snap coupler device, a twist coupler device, a quick release coupler device, a slide coupler device, or a combination of the same. A display mount (15) and a flexible stem (3) may be separable components as described above, or a single integral component, such as preferably an overmolded fiberglass component or a single injection molded component and the like.

Figure 3A:
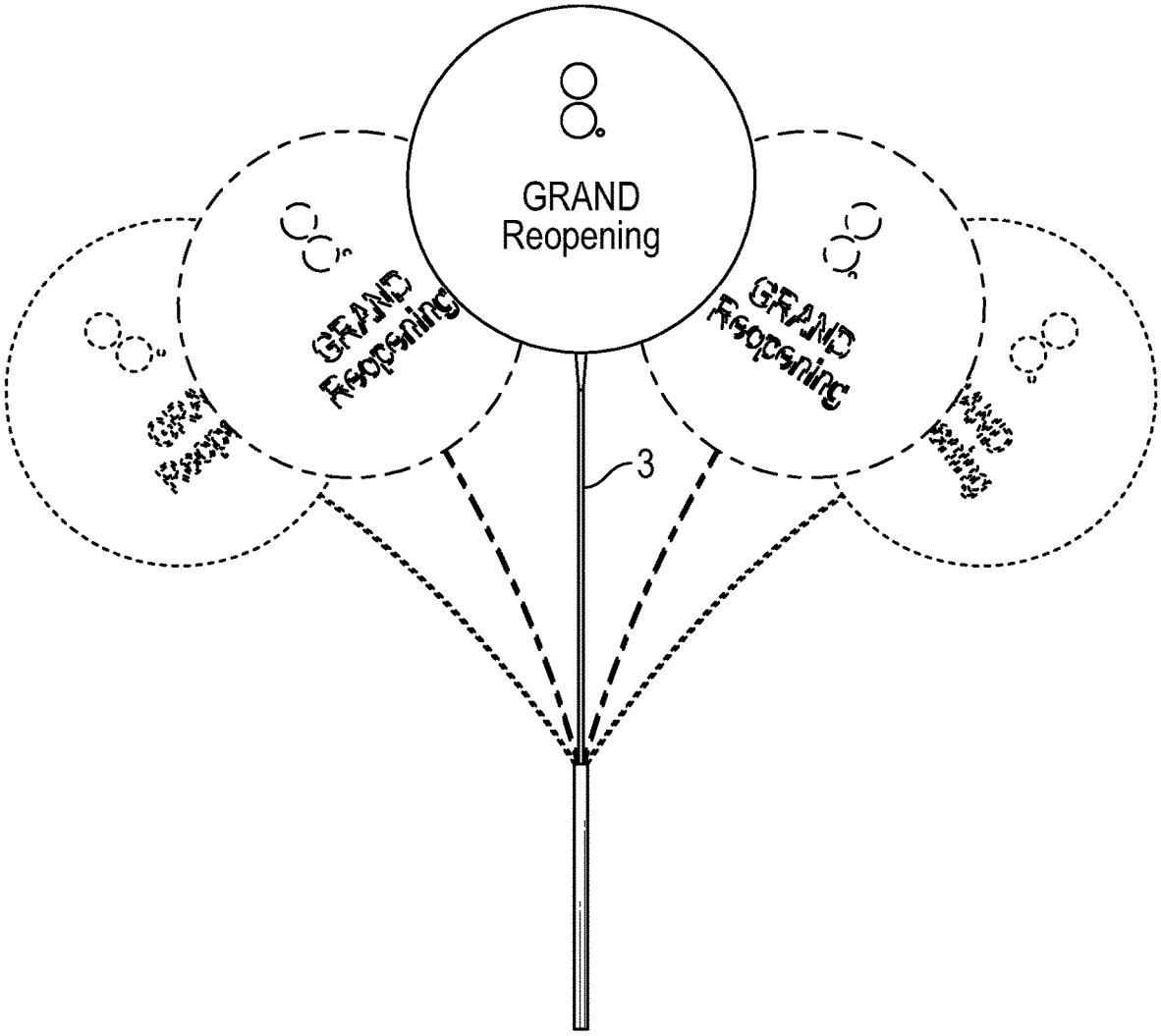
FIG. 3A shows a movable display system coupled with a helium-free balloon in one embodiment thereof.
Figure 3B:
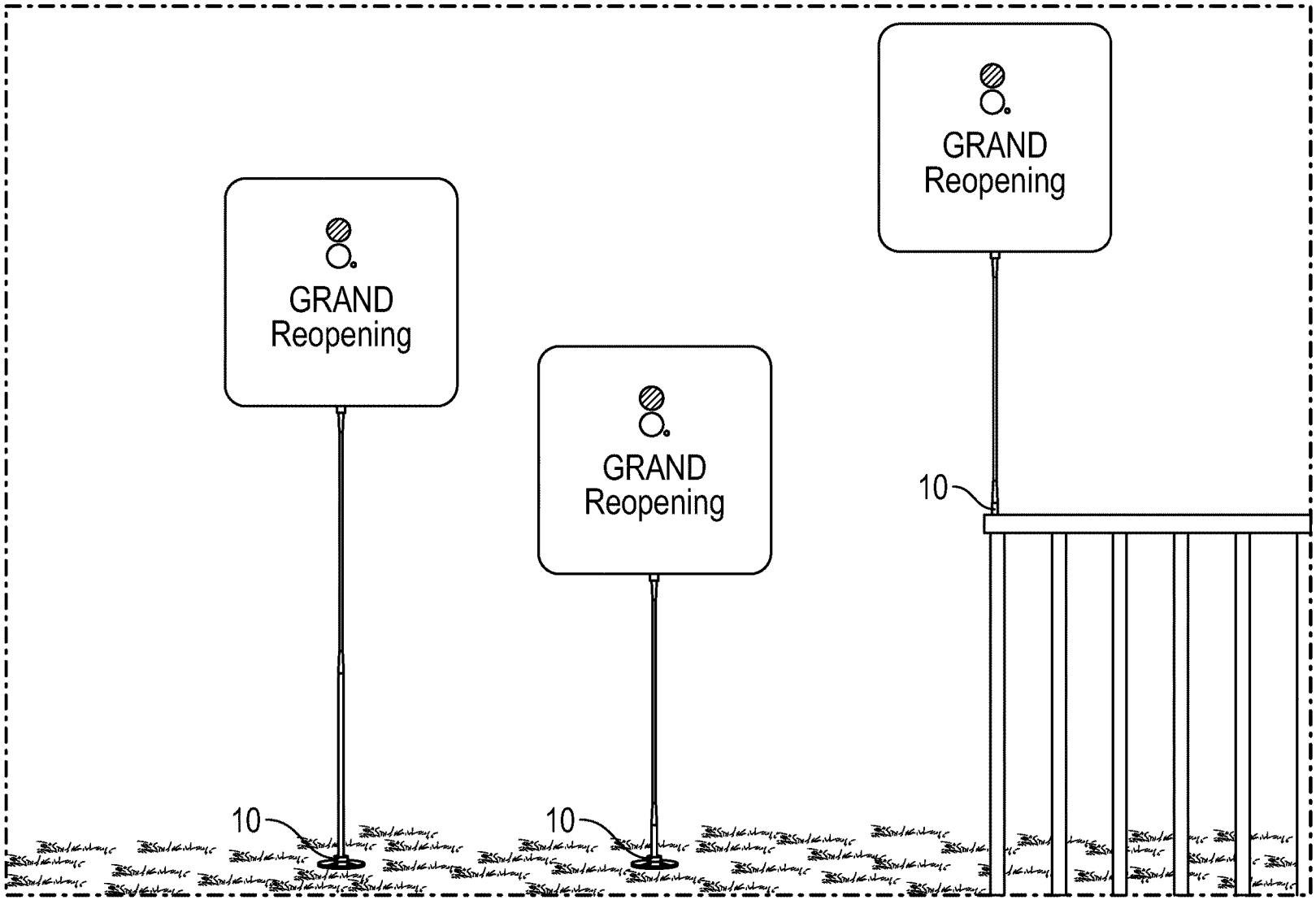
FIG. 3B shows a plurality of movable display systems secured to an external surface through a surface mount in one embodiment thereof.

As noted in FIG. 3, the flexible stem (3) of the invention may be sufficiently flexible to flex in response to an external force, such as the force generated by wind against the surface of a coupled sign (2) or the device generally. The flexible stem (3) of the invention may further be sufficiently rigid to cause the stem to return to its original position in response to the removal of an external force, such as the removal of the force generated by wind against the surface of a coupled sign (2) or the device generally. In one preferred embodiment, the flexible stem (3) of the invention may include a fiberglass flexible stem (2), however other materials, such as plastics, thermoplastics, or composite materials may also fall within the scope of the invention.

As further shown in FIG. 3, a flexible stem (3) may be coupled to an external surface, such as the ground, a wall, a railing, a car, or a pole, with a surface mount (10). In a preferred embodiment, a surface mount (10) may be selected from the group consisting of: a weighted mount; a wall mount; a pole mount, a car mount; and a ground stake. In still further embodiments, a self-adjusting support plate device, as described in U.S. Pat. No. 10,850,206, may be used to secure a flexible stem (3) in the ground or other penetrable surface. The flexible stem (3), being secured in a static position by the surface mount (10), allows the sequential flexing and return movement of the flexible stem (3) in response to an external force, such as a wind force applied to the coupled marketing display, such as a sign (2) or the device generally.

Figure 1B:
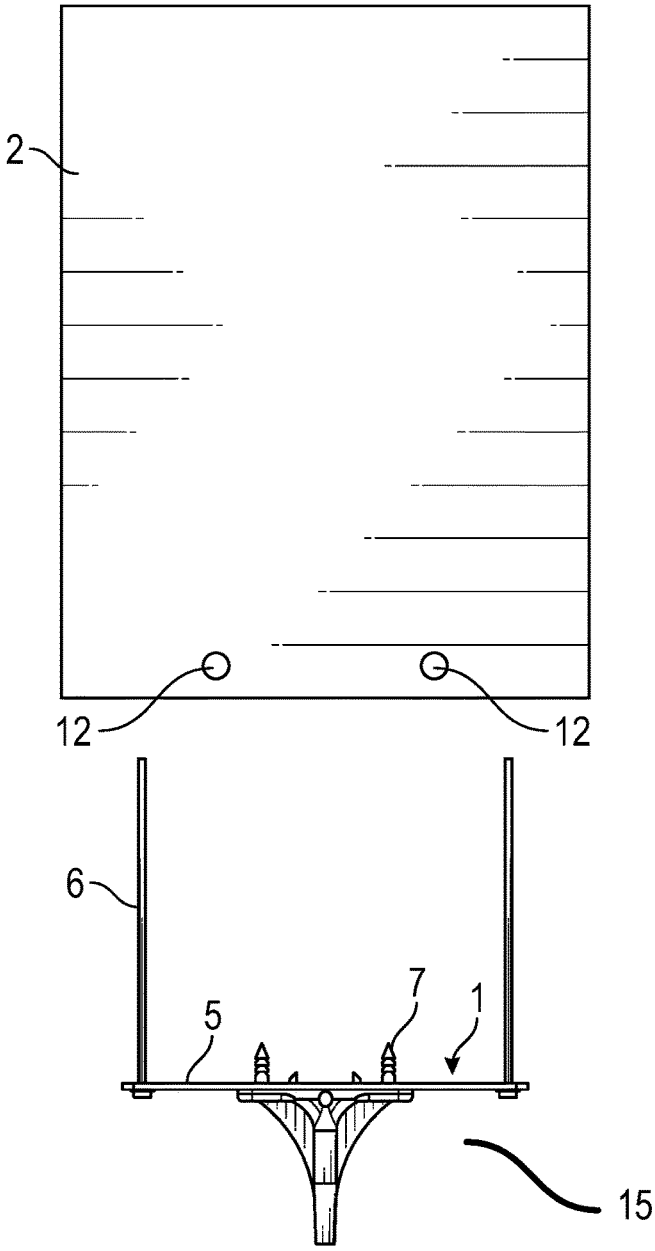
FIG. 1B shows an exploded view of a movable display system in one embodiment thereof.

The display mount (15) of the invention may be configured to secure one or more marketing displays, such as signs (2), banners, flags, one or more helium-free balloons (11) or a combination of the same. In the preferred embodiment shown in FIG. 1, a display mount (15) of the invention may be configured to secure a sign (2). In this embodiment, a display mount (15) may include a support surface (5) horizontally positioned and extending the approximate length of the sign (2) to be attached. The support surface (5) may include one, or preferably a plurality of support rods (6) that may extend upward from he support surface (5). As shown in FIG. 1B, the support rods (6) of the invention may include narrow extended rods configured to be inserted into a sign (2) securing it to the display mount (15). In this embodiment, two separate support rods (6) are positioned at the terminal ends of the support surface (5) such that a sign (2), and preferably a corrugated plastic sign, may be positioned over the support rods (6) extending approximately the full length of the sign (2). The placement of the support rods (6) on the outer edges of the sign allows the support rods (6) to secure the sign (2) as it moves in response to a wind force. In certain embodiment, the sign (2) may include an internally positioned channel configured to receive a support rod (2)

In alternative embodiments, the support rods (6) of the invention may include one or more separate support rods (6) that form a clamping structure such that a marketing display, such as a sign (2), can be positioned between the support rods (6) which is secured to the external surface of the display.

Figure 2B:
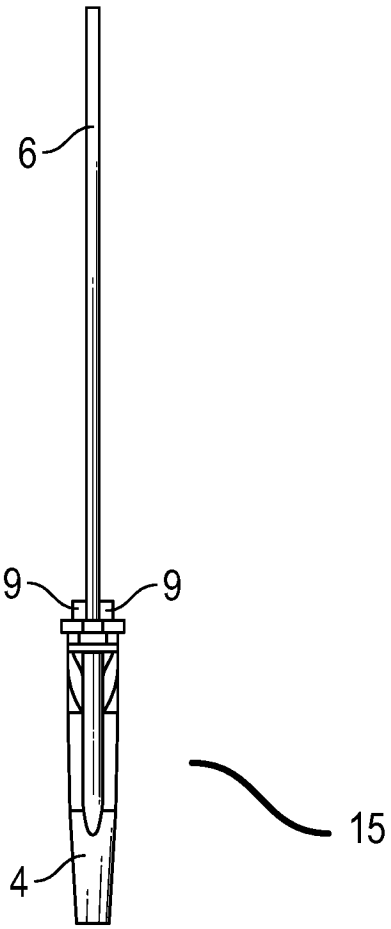
FIG. 2B shows a side view of an isolated display mount in one embodiment thereof.
Figure 2A:
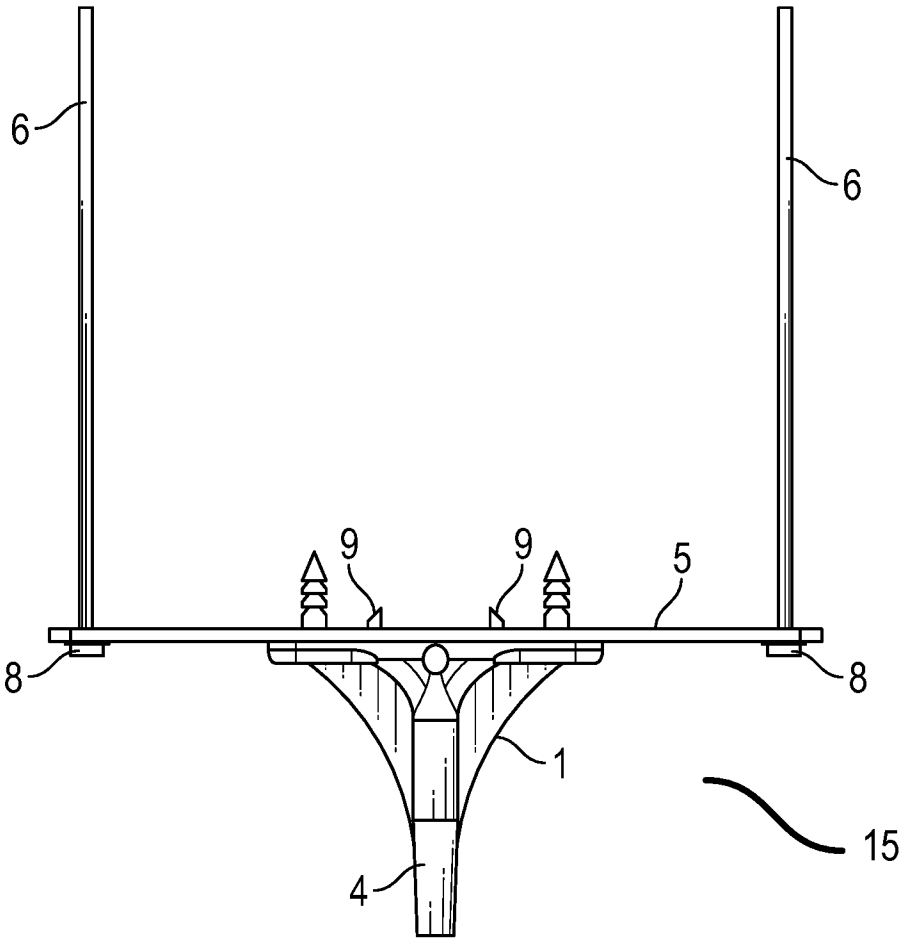
FIG. 2A shows a front view of an isolated display mount in one embodiment thereof.
Figure 2D:
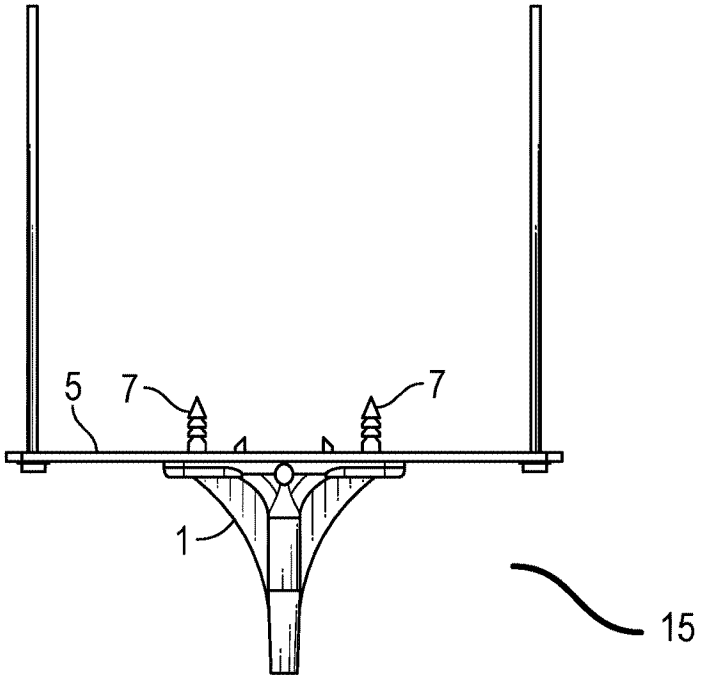
FIG. 2D shows a front view of an isolated display mount in one embodiment thereof.
Figure 2C:
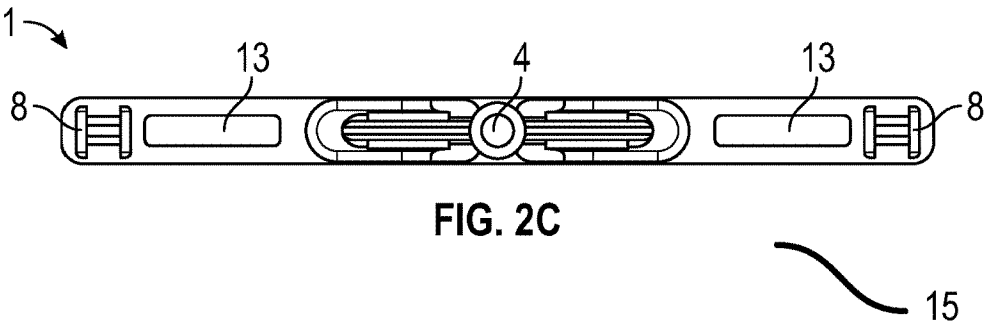
FIG. 2C shows a bottom view of an isolated display mount in one embodiment thereof.

In one embodiment, the display mount (15) of the invention may include one or more lateral fasteners (7). As shown in FIG. 2A, a lateral fastener (7) of the invention may include a flat extension extending from the support surface (5) that is configured to be laterally inserted into the sign (2) securing it to the body of the display mount (15). The lateral fastener (7) may include one or more securing features, such as barbed extension that may allow the lateral fastener (7) to catch and secure the sign adjacent to the support surface (5) of the display mount (15). Notably, both the display mount (15), and support surface (5) may be an integral single component, or separable components. Similarly, the lateral fastener (7) of the invention may be a separate or integral component with the display mount (15), support surface (5), or both.

In another embodiment, the display mount (15) of the invention may include one or more guides (9). As shown generally in FIG. 2, in this embodiment a sign (2) may be positioned along the lateral surface of the support surface (5) with the bottom leading edge of the sign (2) being inserted into one or more guides (9). In this embodiment, the guide (9) may include a raised extension, and/or a slot that is configured to secure the bottom leading edge of the sign (2) to the lateral surface of the support surface (5). In this embodiment, the guide (9) of the invention may be configured to form a compressive fit with the bottom leading edge of the sign (2), while in alternative embodiments the guide (9) of the invention may include one or more lateral barbs configured to catch and secure the surface of the sign (2). In still further embodiments, a guide (9) of the invention may be movable, such that it can be clamped to, and secure the external surface of a sign (2) to the display mount (15).

An another preferred embodiment, a sign (2) of the invention may include one or more sign apertures (12). As shown in FIGS. 1A-B, one or more sign apertures (12) may be positioned along the bottom leading edge of the sign (2) such that when the sign (2) is secured with the display mount (15) the apertures are positioned adjacent to corresponding mounting apertures (13), in this case on the support surface (5) of the display mount (15). In this configuration, a sign coupler (14), such as a zip tie, or other similar securing device, may be positioned in both apertures (12, 14) and locked, thereby securing the sign (2) to the display mount (15).

Naturally, all embodiments discussed herein are merely illustrative and should not be construed to limit the scope of the inventive technology consistent with the broader inventive principles disclosed. As may be easily understood from the foregoing, the basic concepts of the present inventive technology may be embodied in a variety of ways. It generally involves systems, methods, and techniques as well as devices to accomplish a movable display system. In this application, the techniques, including novel and unique uses of manufacturing methods and materials, are disclosed as part of the results shown to be achieved by the various devices described and as steps which are inherent to utilization. They are simply the natural result of utilizing the devices as intended and described. In addition, while some devices are disclosed, it should be understood that these not only accomplish certain methods but also can be varied in a number of ways. Importantly, as to all of the foregoing, all of these facets should be understood to be encompassed by this disclosure.

The discussion included in this provisional application is intended to serve as a basic description. The reader should be aware that the specific discussion may not explicitly describe all embodiments possible; many alternatives are implicit. It also may not fully explain the generic nature of the inventive technology and may not explicitly show how each feature or element can actually be representative of a broader function or of a great variety of alternative or equivalent elements. Again, these are implicitly included in this disclosure. Where the inventive technology is described in device-oriented terminology, each element of the device implicitly performs a function. Apparatus claims may not only be included for the device described, but also method or process claims may be included to address the functions the inventive technology and each element performs. Neither the description nor the terminology is intended to limit the scope of the claims that will be included in any subsequent patent application.

It should also be understood that a variety of changes may be made without departing from the essence of the inventive technology. Such changes are also implicitly included in the description. They still fall within the scope of this inventive technology. A broad disclosure encompassing both the explicit embodiment(s) shown, the great variety of implicit alternative embodiments, and the broad apparatus, methods or processes and the like are encompassed by this disclosure and may be relied upon when drafting the claims for any subsequent patent application. It should be understood that such language changes and broader or more detailed claiming may be accomplished at a later date (such as by any required deadline) or in the event the applicant subsequently seeks a patent filing based on this filing. With this understanding, the reader should be aware that this disclosure is to be understood to support any subsequently filed patent application that may seek examination of as broad a base of claims as deemed within the applicant's right and may be designed to yield a patent covering numerous aspects of the inventive technology both independently and as an overall system.

Further, each of the various elements of the inventive technology and claims may also be achieved in a variety of manners. Additionally, when used or implied, an element is to be understood as encompassing individual as well as plural structures that may or may not be physically connected. This disclosure should be understood to encompass each such variation, be it a variation of an embodiment of any apparatus embodiment, a method or process embodiment, or even merely a variation of any element of these. Particularly, it should be understood that as the disclosure relates to elements of the inventive technology, the words for each element may be expressed by equivalent apparatus terms or method terms—even if only the function or result is the same. Such equivalent, broader, or even more generic terms should be considered to be encompassed in the description of each element or action. Such terms can be substituted where desired to make explicit the implicitly broad coverage to which this inventive technology is entitled. As but one example, it should be understood that all actions may be expressed as a means for taking that action or as an element which causes that action. Similarly, each physical element disclosed should be understood to encompass a disclosure of the action which that physical element facilitates. Regarding this last aspect, as but one example, the disclosure of an "coupler" should be understood to encompass disclosure of the act of "coupling"—whether explicitly discussed or not—and, conversely, were there effectively disclosure of the act of "coupling", such a disclosure should be understood to encompass disclosure of an "coupling method and/or technique, and or device" and even a "means for coupling." Such changes and alternative terms are to be understood to be explicitly included in the description.

Thus, the applicant(s) should be understood to have support to claim and make a statement of invention to at least: i) each of the methods, apparatus, improvements and/or devices as herein disclosed and described, ii) the related methods disclosed and described, iii) similar, equivalent, and even implicit variations of each of these devices and methods, iv) those alternative designs which accomplish each of the functions shown as are disclosed and described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) each system, method, and element shown or described as now applied to any specific field or devices mentioned, x) methods and apparatuses substantially as described hereinbefore and with reference to any of the accompanying examples, xi) the various combinations and permutations of each of the elements disclosed, xii) each potentially dependent claim or concept as a dependency on each and every one of the independent claims or concepts presented, and xiii) all inventions described herein.

With regard to claims whether now or later presented for examination, it should be understood that for practical reasons and so as to avoid great expansion of the examination burden, the applicant may at any time present only initial claims or perhaps only initial claims with only initial dependencies. The office and any third persons interested in potential scope of this or subsequent applications should understand that broader claims may be presented at a later date in this case, in a case claiming the benefit of this case, or in any continuation in spite of any preliminary amendments, other amendments, claim language, or arguments presented, thus throughout the pendency of any case there is no intention to disclaim or surrender any potential subject matter. It should be understood that if or when broader claims are presented, such may require that any relevant prior art that may have been considered at any prior time may need to be re-visited since it is possible that to the extent any amendments, claim language, or arguments presented in this or any subsequent application are considered as made to avoid such prior art, such reasons may be eliminated by later presented claims or the like. Both the examiner and any person otherwise interested in existing or later potential coverage or considering if there has at any time been any possibility of an indication of disclaimer or surrender of potential coverage, should be aware that no such surrender or disclaimer is ever intended or ever exists in this or any subsequent application. Limitations such as arose in *Hakim v. Cannon Avent Group, PLC,* 479 F.3d 1313 (Fed. Cir 2007), or the like are expressly not intended in this or any subsequent related matter. In addition, support should be understood to exist to the degree required under new matter laws—including but not limited to European Patent Convention Article 123(2) and United States Patent Law 35 USC 132 or other such laws—to permit the addition of any of the various dependencies or other elements presented under one independent claim or concept as dependencies or elements under any other independent claim or concept. In drafting any claims at any time whether in this application or in any subsequent application, it should also be understood that the applicant has intended to capture as full and broad a scope of coverage as legally available. To the extent that insubstantial substitutes are made, to the extent that the applicant did not in fact draft any claim so as to literally encompass any particular embodiment, and to the extent otherwise applicable, the applicant should not be understood to have in any way intended to or actually relinquished such coverage as the applicant simply may not have been able to anticipate all eventualities; one skilled in the art, should not be reasonably expected to have drafted a claim that would have literally encompassed such alternative embodiments.

Further, if or when used, the use of the transitional phrase "comprising" is used to maintain the "open-end" claims herein, according to traditional claim interpretation. Thus, unless the context requires otherwise, it should be understood that the term "comprise" or variations such as "comprises" or "comprising", are intended to imply the inclusion of a stated element or step or group of elements or steps but not the exclusion of any other element or step or group of elements or steps. Such terms should be interpreted in their most expansive form so as to afford the applicant the broadest coverage legally permissible. The use of the phrase, "or any other claim" is used to provide support for any claim to be dependent on any other claim, such as another dependent claim, another independent claim, a previously listed claim, a subsequently listed claim, and the like. As one clarifying example, if a claim were dependent "on claim 20 or any other claim" or the like, it could be re-drafted as dependent on claim 1, claim 15, or even claim 715 (if such were to exist) if desired and still fall with the disclosure. It should be understood that this phrase also provides support for any combination of elements in the claims and even incorporates any desired proper antecedent basis for certain claim combinations such as with combinations of method, apparatus, process, and the like claims.

Finally, any claims set forth at any time are hereby incorporated by reference as part of this description of the inventive technology, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

What is claimed is:

1. A movable display system comprising:

a display mount having a support surface;

a flexible stem coupled with said display mount;

a sign;

a surface mount coupled with said flexible stem;

one or more flat lateral fasteners having one or more barbs positioned on the support surface, configured to be laterally inserted into the sign securing it to the support surface of the display mount;

one or more guides positioned on the support surface, wherein said guide comprises a slot configured to secure the external surface of the sign securing it to the support surface of the display mount; and wherein said flexible stem moves in response to an external force and returns to its initial position once said force is removed.

2. The system of claim 1, wherein said flexible stem comprises a fiberglass flexible stem.

3. The system of claim 1, wherein said flexible stem is coupled with said display mount through a stem engagement.

4. The system of claim 1, wherein said sign comprises a corrugated plastic sign.

5. The system of claim 1, further comprising a plurality of support rods coupled with said support surface and positioned within the sign near an outer edge.

6. The system of claim 1, wherein said sign comprises a sign having a sign aperture.

7. The system of claim 6, and further comprising a mounting aperture.

8. The system of claim 7, and further comprising a sign coupler configured to secure said sign aperture and said mounting aperture.

9. A movable display system comprising:

a display mount having a support surface;

a flexible stem coupled with said display mount;

a sign secured with at least one flat lateral fastener wherein said at least one lateral fastener has one or more barbs positioned on the support surface, configured to be laterally inserted into the sign securing it to the support surface of the display mount;

a surface mount coupled with said flexible stem; and wherein said flexible stem moves in response to an external force and returns to its initial position once said force is removed.

10. The system of claim 9, wherein said flexible stem comprises a fiberglass flexible stem.

11. The system of claim 9, wherein said flexible stem is coupled with said display mount through a stem engagement.

12. The system of claim 9, further comprising a plurality of support rods coupled with said support surface and positioned within the sign near an outer edge.

13. The system of claim 9, wherein said sign comprises a sign having a sign aperture.

14. The system of claim 13, and further comprising a mounting aperture.

15. The system of claim 14, and further comprising a sign coupler configured to secure said sign aperture and said mounting aperture.

16. The system of claim 9, further comprising one or more guides positioned on the support surface, wherein said guide comprises a slot configured to secure the external surface of the sign securing it to the support surface of the display mount.

* * * * *